United States Patent [19]

Kubach

[11] Patent Number: 4,546,339

[45] Date of Patent: Oct. 8, 1985

[54] POLE STRUCTURE FOR A POLARIZED ELECTROMAGNET

[75] Inventor: Hans Kubach, Korntal-Münchingen, Fed. Rep. of Germany

[73] Assignee: Robert Bosch GmbH, Stuttgart, Fed. Rep. of Germany

[21] Appl. No.: 643,230

[22] Filed: Aug. 22, 1984

[30] Foreign Application Priority Data

Oct. 4, 1983 [DE] Fed. Rep. of Germany ..... 3336011

[51] Int. Cl.[4] ..... H01F 7/08

[52] U.S. Cl. ..... 335/230; 335/234; 335/266

[58] Field of Search ..... 335/78, 81, 85, 229, 335/234, 266, 230

[56] References Cited

U.S. PATENT DOCUMENTS 3,143,690 8/1964 Young ..... 335/230
4,020,433 4/1977 Uchidoi et al. ..... 335/230
4,240,055 12/1980 Shimizu et al. ..... 335/229 X

*Primary Examiner*—George Harris
*Attorney, Agent, or Firm*—Edwin E. Greigg

[57] ABSTRACT

An electromagnet is proposed which serves in particular to actuate a fuel injection valve for fuel injection systems in internal combustion engines. The electromagnet includes a first pole piece disposed at one side of a first permanent magnet and a second pole piece disposed at the other side of the first permanent magnet. The pole pieces each have one conduction section bent at an angle, which sections are oriented toward one another and define a gap therebetween. Divided from the first permanent magnet by the conduction sections, a magnet coil is disposed on each pole piece. The first pole piece has a pole oriented toward the armature, and the second pole piece has a pole. When the magnet coils are not excited, the armature is drawn in the direction toward the poles by one component ($\phi_{p2}$) of the permanent magnetic flux. If the magnet coils experience a flow through them of a current (i) in such a manner that an electromagnetic flux ($\phi_i$) flows through the armature in the opposite direction from the flux ($\phi_{p2}$), then the armature drops away from the poles whenever the electromagnetic flux ($\phi_i$) becomes equal to the component ($\phi_p 2$) of the permanent magnetic flux.

5 Claims, 5 Drawing Figures

POLE STRUCTURE FOR A POLARIZED ELECTROMAGNET

BACKGROUND OF THE INVENTION

The invention is based on an electromagnet as generally defined hereinafter. An electromagnetically actuated valve has already been proposed in which the armature, in the non-excited state, assumes a position spaced apart from the core, while upon electromagnetic excitation the armature is drawn toward the core. In many applications, however, an embodiment of this kind is often undesirable, because for instance, when it is used as an outwardly opening injection valve the electromagnet system must be continuously excited in order to close the valve

OBJECT AND SUMMARY OF THE INVENTION

The electromagnet according to the invention has the advantage that in the non-excited state of the electomagnet the armature rests on the core, and when the electromagnet is excited the armature drops away from the core. The electromagnet is compact in size and has a long life with very high triggering accuracy.

A particularly advantageous feature of the invention whereby the cross sections of the pole pieces can be very greatly reduced, enabling not only miniaturization but a lessening of leakage losses.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
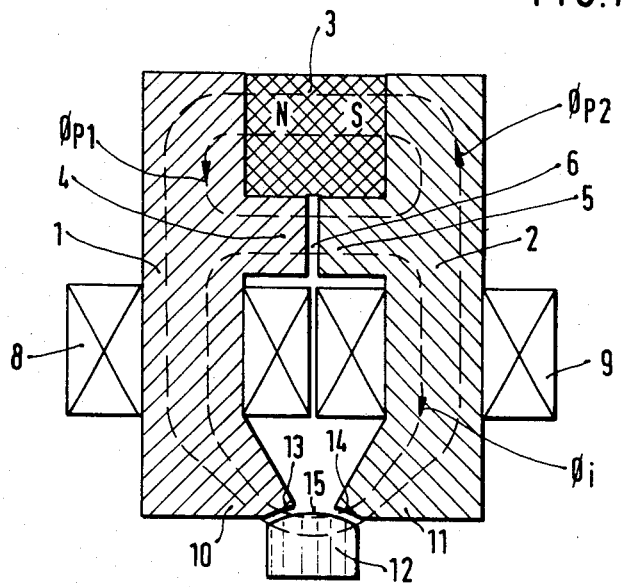
FIG. 1 shows a first exemplary embodiment of an electromagnet according to the invention.

In the first exemplary embodiment of an ellectromagnet shown in FIG. 1, the core is embodied by a first pole piece 1 and a second pole piece 2 of soft iron, which, extending virtually parallel, each rest on a different end of a first permanent magnet 3. The first pole piece 1 has a first conduction section 4 bent at an angle, and the second pole piece 2 has a second conduction section 5 bent at an angle. The first conduction section 4 and the second conduction section 5 oriented are to extend toward one another in such a way that they define an air gap 6 therebetween. A first magnet coil 8 is disposed on the first pole piece 1 and a second magnet coil 9 is disposed on the second pole piece 2. The first conduction section 4 and the second conduction section 5 extend between the first permanent magnet 3 and the magnet coils 8 and 9. Remote from the first permanent magnet 3, the first pole piece 1 terminates in a first pole 10 and the second pole piece 2 terminates in a second pole 11. An armature 12 of soft magnetic material is supported in the vicinity of the poles 10, 11 such that it is capable of executing an axial movement. The poles 10, 11 are suitably directed toward the armature 12 in such a way that the lines of flux are capable of taking the most favorable course. Thus the poles 10, 11 can be provided with an inclination oriented toward one another and can have concave surfaces 13 on pole 10 and 14 on pole 11 extending across both poles 10, 11 these concave surfaces 13 and 14 being oriented toward a convex surface 15 of the armature 12.

Figure 5:
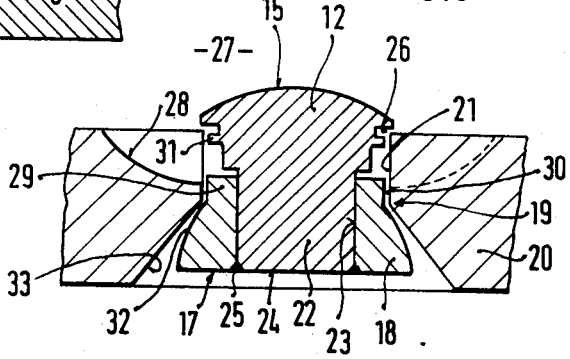
FIG. 5 is a detail showing a valve element actuated by an armature.

As shown by way of example in FIG. 5, the armature 12 may be connected with a movable valve element 17 of a fuel injection valve, not otherwise shown, for fuel injection systems of internal combustion engines, by way of which fuel can be injected into the intake tube of internal combustion engines in a known manner. The movable valve element 17 is fabricated of nonmagnetic material and has a sealing element 18 which cooperates with a valve seat 19 in a valve seat body 20 of nonmagnetic material. The valve seat body 20 is inserted into a valve housing not otherwise shown. Upstream of the valve seat 19, a flow bore 21 is provided in the valve seat body 20, through which bore a tang 22 of the armature 12 protrudes partway, the tang 22 being secured in a bore 23 of the valve element 17. The tang 22 is preferably inserted into the securing bore 23 as far as the end face 24 of the valve element 17 and welded to the valve element 17 at 25. The valve stroke—that is, the stroke of the elements 12, 17—can be fixed in a desired manner by the appropriate axial association of the armature 12 and the valve element 17. Remote from the convex surface 15, a flat stop face 26 is provided on the armature 12, coming to rest on the valve seat body 20 when the sealing element 18 is raised from the valve seat 19. The fuel supplied to the fuel injection valve from a fuel supply source (not shown) travels from an inner chamber 27 of the fuel injection valve into fuel conduits 28, which are embodied in the valve seat body and discharge into the flow bore 21, in which a circular-symmetrical distribution of the fuel is effected to a flow cross section 30 between the flow bore 21 and the circumference of a connecting part 29 of the movable valve element 17. The flow cross section 30 may be embodied for throttling and thus may serve the purpose of fuel metering. The radial centering of the armature 12 and valve element 17 may be provided by a narrow cylindrical guide section 31 on the tang 22, which protrudes with a tight fit into the flow bore 21. If the outwardly opening valve element 17 has lifted away from the valve seat 19, then the armature 12 rests with its stop face 26 on the valve seat body 20, and fuel is capable of passing, in the form of a fuel film of equal thickness throughout, via the opened valve seat 19 to an annular gap 32, which is formed with an increasing diameter between the spherically shaped surface of the sealing element 18 and an injection port 33 adjoining the valve seat 19 in the valve seat body 20 in the flow direction; this passage of the fuel is such that the fuel flows to the outside on the surface of the sealing element and mixes with the ambient air, which after the tearing off of the conically shaped fuel film when it reaches the sharp-edged end face 24 of the sealing element 18 likewise mixes from the inside out with the fuel.

In FIG. 1, the flux $\phi_p$ of the first permanent magnet 3 is split up into the components $\phi_{p1}$ and $\phi_{p2}$. The flux $\phi_{p1}$ travels via the conduction sections 4, 5 and the air gap 6, while the flux $\phi_{p2}$ travels via the pole pieces 1, 2 having the poles 10, 11 and via the armature 12. When the magnet coils 8, 9 have no electric current through them, the armature 12 is thus attracted by the flux $\phi_{p2}$, for instance the saturation flux $\phi_{2sat}$, and rests on the poles 10, 11. The conduction sections 4, 5 having the air gap 6 are necessary, because the first permanent magnet 3 conducts the electromagnetic flux $\phi_i$ only poorly. The electromagnetic flux $\phi_i$ arises from the application of a current i to each of the magnet coils 8, 9 and extends via the armature 12 in the opposite direction from that of the permanent magnet flux $\phi_{p2}$. For the sake of simplicity the electromagnetic flux $\phi_i$ is guided only via the air gap 6. It is advantageous to select for the components of the permanent magnet flux $\phi_p$ a ratio of $\phi_{p1}=2\ \phi_{p2}=2\ \phi_{2sat}$. When the magnet coils 8, 9 are without current, the armature 12 is urged in the direction toward the poles 10, 11 in an embodiment of a valve corresponding to FIG. 5; that is, the valve element 17 is held in the closing position on the valve seat 19. If a current i is now applied to the magnet coils 8, 9 in such a manner that a magnetic flux $\phi_i$ flows via the armature 12 in the opposite direction from the flux $\phi_{p2}$, then the armature 12 will rise from the poles 10, 11 whenever the electromagnetic flux $\phi_i$ is approximately equal to the components of the permanent magnet flux $\phi_{p2}$. When the armature lifts away from the poles 10, 11, the valve element 17 is simultaneously lifted away from the valve seat 19, and the injection valve shown in FIG. 5 opens. A limitation of the electromagnetic flux $\phi_i$ can be effected by means of a saturation in the conduction sections 4, 5.

Figure 2:
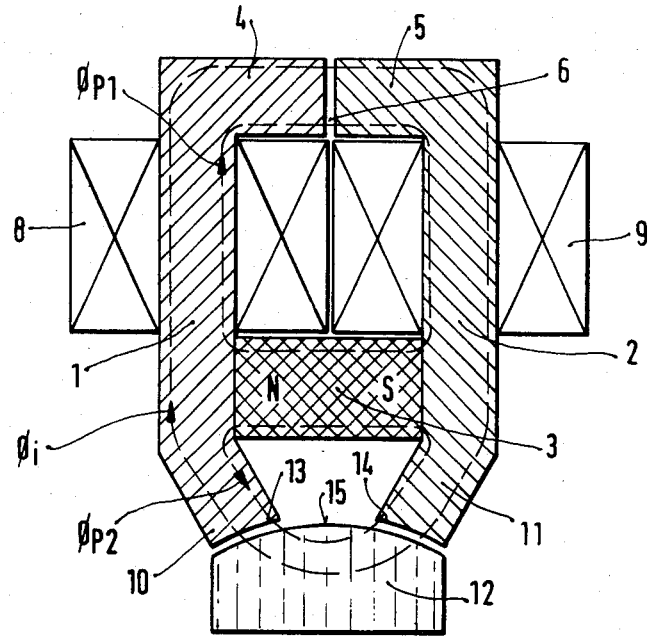
FIG. 2 shows a second exemplary embodiment of an electromagnet according to the invention.

In the second exemplary embodiment of an electromagnet shown in FIG. 2, elements which remain the same and function the same as those of the embodiment of FIG. 1 are identified by the same reference numerals. In terms of its structure, the exemplary embodiment of FIG. 2 differs from that of FIG. 1 in that the first permanent magnet 3 joins the pole pieces 1, 2 between the poles 10, 11 and the magnet coils 8, 9 and the magnet coils 8, 9 are disposed on the pole pieces 1, 2 between the first permanent magnet 3 and the conduction sections 4, 5. The conduction sections 4, 5 having the air gap 6 are necessary here in order that the first permanent magnet 3 will not be short-circuited. As in the exemplary embodiment of FIG. 1, the electromagnetic flux $\phi_i$ in the embodiment of FIG. 2 is also intended to travel through the armature 12 in the opposite direction from the components of the permanent magnet flux $\phi_{p2}$, so that as long as the electromagnetic flux $\phi_i$ is less than the permanent magnetic flux $\phi_{p2}$, the armature is held on the poles 10, 11, while if $\phi_i=\phi_{p2}$, no magnetic force is exerted upon the armature 12 any longer and the armature 12 is capable of moving away from the poles 10, 11.

Figure 3:
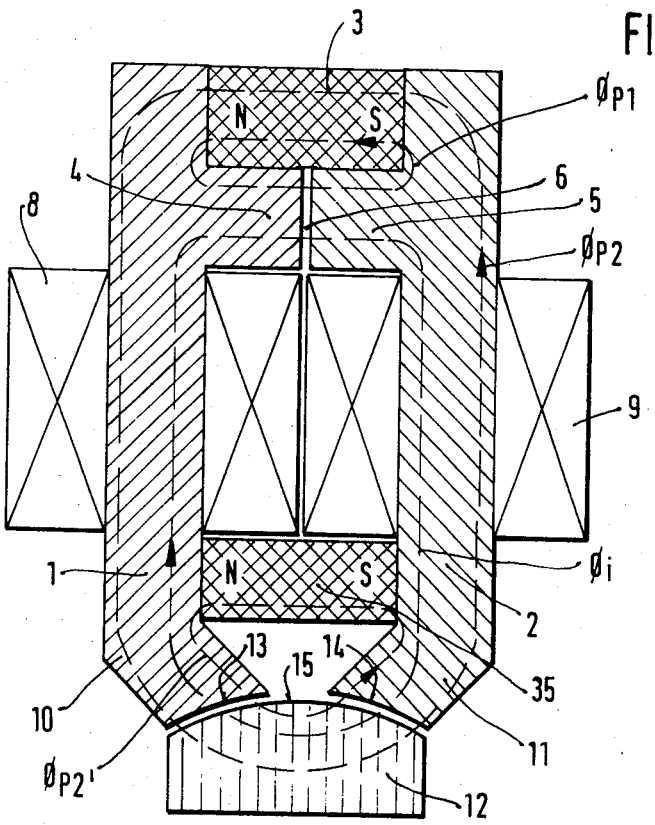
FIG. 3 shows a third exemplary embodiment of an electromagnet according to the invention.
Figure 4:
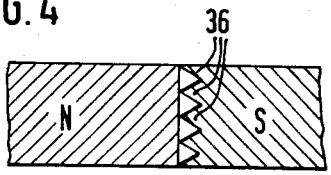
FIG. 4 is a detail showing the embodiment of conduction sections.

In the third exemplary embodiment shown in FIG. 3, elements remaining the same and functioning the same as those of the foregoing embodiments are again identified by the same reference numerals. Differing from the embodiment of FIG. 1, a second permanent magnet 35 is disposed between the magnet coils 8, 9 and the poles 10, 11, joining the pole pieces 1, 2, in the embodiment of FIG. 3. The result is a flux effected by the permanent magnets 3 and 35 via the armature 12, which is composed of the component $\phi_{p2}$ of the first permanent magnet 3 and the component $\phi_{p2'}$, acting in the same direction, of the same permanent magnet 35, and which is counteracted in the opposite direction by the electromagnetic flux $\phi_i$ of the magnet coils 8, 9. With a suitable selection of the fluxes of the two permanent magnets 3, 35, substantially smaller cross sections of the pole pieces 1, 2 are necessary in the exemplary embodiment of FIG. 3 than in the exemplary embodiments of FIGS. 1 and 2.

In FIGS. 1, 2 and 3 the armature 12 is in each case shown in a position in which it has dropped away from the poles 10, 11 and hence a fuel injection valve embodied in accordance with FIG. 5 is thus arranged to open.

To compensate for the effects of temperature, the region around the air gap 6 at the conduction sections 4, 5 may be realized in a magnetic material having a large negative temperature coefficient of the saturation induction. A magnet arrangement of this kind shunts away less permanent magnetic flux at a high temperature. For example, in a manner not shown, a material of this kind, which is driven in the saturation range, may be disposed parallel to the air gap 6. It is more economical for the saturated temperature-dependent magnet conductor to be saturated only in a region adjacent to the non-saturated magnet conductor, this being accomplished in that at least one of the conduction sections 4, 5 has a profile marked with points 36 at its end face oriented toward the other conduction section. The saturated points 36 shunt away less permanent magnetic flux, as desired, at a relatively high temperature. Since the saturation characteristic is not pronounced, because of the flat saturation region, the electromagnetic flux $\phi_i$ can flow relatively easily in the direction of additional saturation. The resistance offered to the electromagnetic flux $\phi_i$ by the saturated material is greater at higher temperatures, so that $\phi_i$ at a high temperature decreases similarly to the permanent magnet flux.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An electromagnet, in particular for controlling a fuel injection valve for fuel injection systems for internal combustion engines, having an armature and a core of soft magnetic material, characterized in that said core comprises a first pole piece disposed at one side of a first permanent magnet and arranged to support a first magnet coil and a second pole piece disposed at an opposite side of the first permanent magnet and arranged to support a second magnet coil, said first pole piece including a first pole having a concave surface oriented toward the armature and a first conduction section bent at an angle thereto, said second pole piece including a second pole having a concave surface oriented toward the armature and a second conduction section bent at an angle thereto, said first and second conduction sections being disposed between said first and second magnet coils and said first permanent magnet in opposed relation so as to define a gap therebetween, said first and second magnet coils are disposed on said pole pieces between said first and second poles and said first and second conduction sections, and said armature is provided with a convex surface on a portion thereof proximate to said concave surfaces on said first and second poles.

2. An electromagnet as defined by claim 1, further wherein a second permanent magnet is disposed between said first and said second magnet coils and said first and said second poles whereby said first pole piece rests on one side of said second permanent magnet and said second pole piece rest on the other side of said second permanent magnet.

3. An electromagnet as defined by claim 1, further wherein at least one of said conduction sections has a profiled end face oriented toward said other conduction section.

4. An electromagnet, in particular for controlling a fuel injection valve for fuel injection systems for internal combustion engines, having an armature and a core of soft magnetic material, characterized in that said core comprises a first pole piece disposed at one side of a first permanent magnet and arranged to support a first magnet coil and a second pole piece disposed at an opposite side of the first permanent magnet and arranged to support a second magnet coil, said first pole piece including a first pole having a concave surface oriented toward the armature and a first conduction section bent at an angle thereto, said second pole piece including a second pole having a concave surface oriented toward the armature and a second conduction section bent at an angle thereto, said armature being provided with a concave surface on a portion thereof proximate to said concave surfaces on said first and second poles, said first and second conduction sections being disposed on one side of said first and second magnet coils and said first permanent magnet in opposed relation so as to define a gap therebetween, and said first and second poles of said first and second pole pieces are disposed on an opposite side of said first and second magnet coils.

5. An electromagnet as defined by claim 4, further wherein at least one of said conduction sections has a profiled end face oriented toward said other conduction section.

* * * * *